United States Patent [19]

Newsome

[11] 4,456,241

[45] Jun. 26, 1984

[54] SUCKER TYPE CARD FEEDER

[76] Inventor: John R. Newsome, R.R. #1, Box 58A, Shumway, Ill. 62461

[21] Appl. No.: 407,509

[22] Filed: Aug. 12, 1982

[51] Int. Cl.[3] ..... B65H 3/08

[52] U.S. Cl. ..... 271/11; 271/98; 271/100; 271/102; 271/132

[58] Field of Search ..... 271/11, 98, 99, 100, 271/102, 107, 132

[56] References Cited

U.S. PATENT DOCUMENTS 2,335,064 11/1943 Kabel ..... 271/102

3,458,042 7/1969 Mestre ..... 271/11 X

*Primary Examiner*—Richard A. Schacher

*Attorney, Agent, or Firm*—Leydig, Voit, Osann, Mayer & Holt, Ltd.

[57] ABSTRACT

A machine for feeding cards one by one from the bottom of a vertical stack into a receiving nip, the trailing edge portion of the stack being supported on a platform and the leading edge of the stack having a stripper type support in the form of a projection which extends under the corner of the stack, the platform being foreshortened to provide a window adjacent the projection. A suction cup supported on a sucker block faces upwardly into the window. The sucker block is mounted on a block carrier which is reciprocated in forward and retract directions. A cam surface and cam follower are interposed between the sucker block and the carrier and a striker is blockingly arranged in the path of retracting movement of the sucker block so that when the carrier is retracted the sucker block engages the striker causing the sucker block to be cammed upwardly completing an L-shaped path in which the suction cup suckingly engages the underside of the bottom card. A biasing spring biases the sucker block downwardly so that in the subsequent forward stroke of the carrier the suction cup retraces its L-shaped path to place the leading edge of the card in the receiving nip. The striker is adjustably positionable to vary the elevation of the suction cup.

9 Claims, 13 Drawing Figures

21
22
90
108
103
104
126
123
124
160
76
131
163
162
100
101
107
102
125
121
122
71
62,6d
70

165
55,56
59
74
71
40
S
11
12
73
72
10
164
162
163
161
75
70
76
131
28
27
15
90
100
105
91
147
140

SUCKER TYPE CARD FEEDER

It is a common practice to insert postcards and subscription order cards in a magazine during the binding process, either anchored permanently in the binding for tearing off by the customer or loosely inserted.

In the binding process such cards are fed downwardly from a stack one by one for transport to an appropriate inserter in the binding line. The stack of cards is supported at its leading edge on a stripper type support, and the bottom card is engaged by a sucker cup which moves vertically into engagement with the bottom card and for drawing it downwardly, causing it to "flick" over the stripper support and into a feeding position. In the past it has been customary to employ separate or rather complicated mechanisms to impart to a sucker cup the vertical and horizontal components of movement required to transport a card from the bottom of the stack to a point of pickup or transport. Moreover, prior devices have been inconvenient to adjust and have been prone to get out of adjustment thereby affecting the reliability of the feed.

It is an object of the present invention to provide a machine for feeding cards one by one from the bottom of a vertical stack which is highly reliable, which is capable of working at the fastest commercial feeding speeds, which is easily adjusted and which is capable of operating continuously over long periods of time without attention, maintenance, or readjustment.

It is another object of the invention to provide a card feeding device for feeding cards along an L-shaped path downwardly and then horizontally outward into a position of pickup, with retracement along the same path upon return, employing a unitary mechanism which is extremely simple and which consists of a minimum number of parts. In this connection it is an object to provide a mechanism employing a horizontally reciprocated carrier and in which a portion of the horizontal stroke is translated, by means of a cam and cam follower, into vertical movement of the suction cup.

It is another object to provide a mechanism of the above type in which the upper limit position of the suction cup and the limit of horizontal forward movement are both subject to quick and lasting adjustment.

It is a more detailed object of the present invention to provide means for securing motion both horizontal and vertical along an L-shaped path and which may be operated at high speed but in which the conversion of motion from one direction to the other takes place smoothly, substantially free of shock or vibration.

It is a generally object of the present invention to provide a mechanism for feeding cards from the bottom of a stack which is easily driven, which is simple and highly economical to construct and install and which is capable of operating over long periods of time without maintenance except for occasional lubrication.

Other objects and advantages of the invention will become apparent upon reading the attached detailed description and upon reference to the drawings in which:

FIG. 1 is a side elevation of a card feeding device constructed in accordance with the present invention.

FIG. 1*a* is a perspective, at reduced scale, of the sucker block mechanism.

Figure 5:
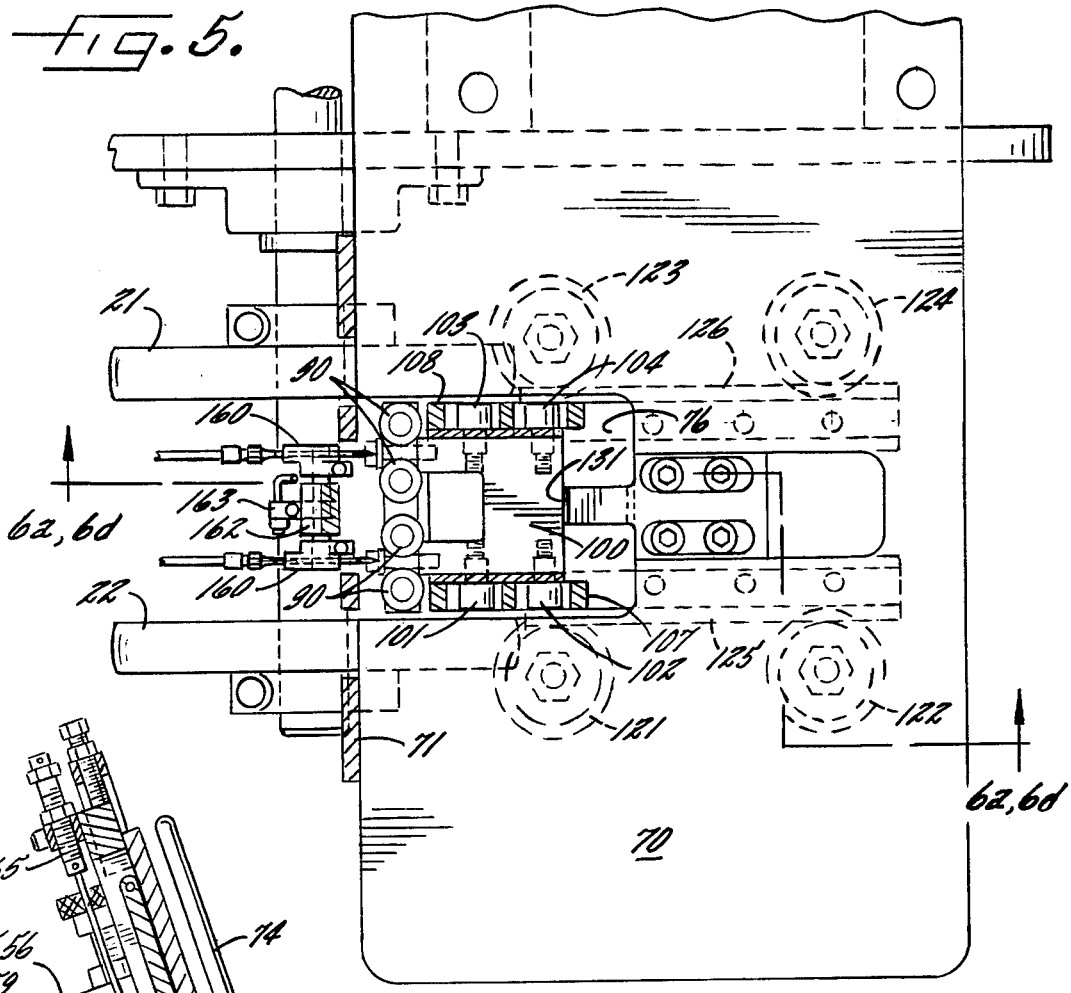
FIG. 5 is a top view in partial section looking along line 5—5 in FIG. 1.
Figure 6A:
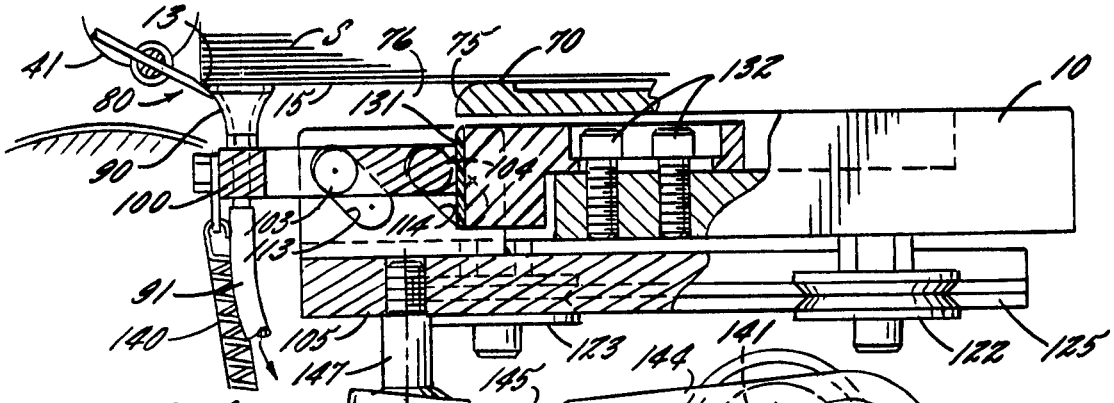

FIGS. 6*a*–6*d* are a series of stop motion views taken along line 6*a*–6*d* in FIG. 5, show in the following:

FIG. 6*a* shows the pitman and sucker block retracted, with the sucker block in its elevated position.

Figure 6B:
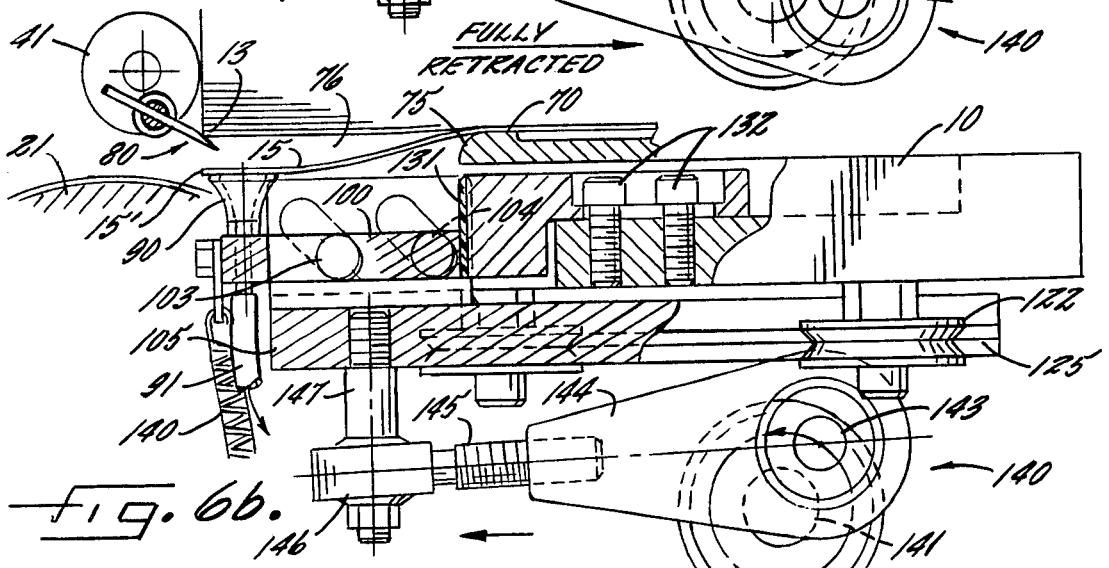

FIG. 6*b* shows the pitman partially advanced with the sucker block in lowered position with incipient separation at the striker.

Figure 6C:
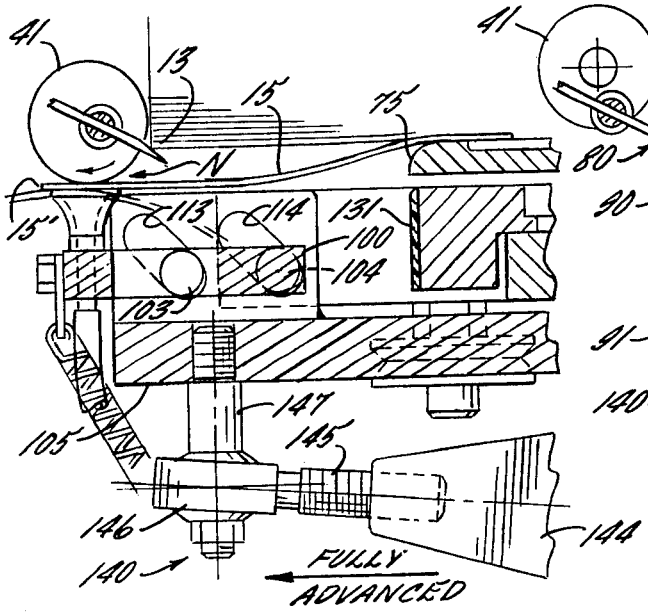

FIG. 6*c* shows the pitman fully advanced for feeding of the engaged card into the nip.

Figure 6D:
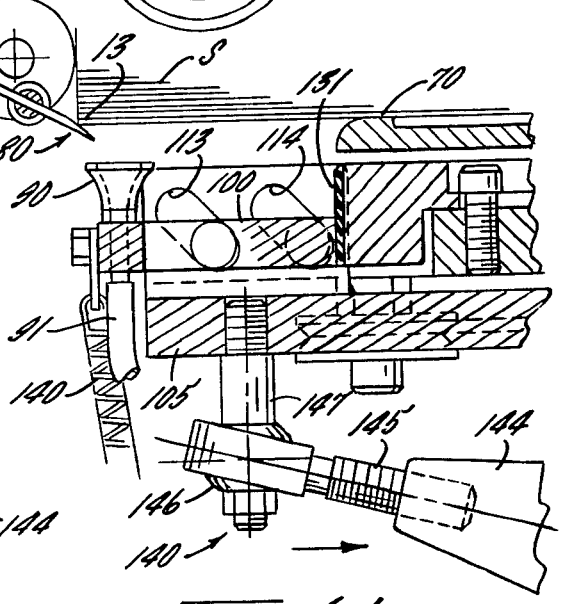

FIG. 6*d* shows the pitman partially retracted, with contact at the striker and with the sucker block about to be elevated.

Figure 7:
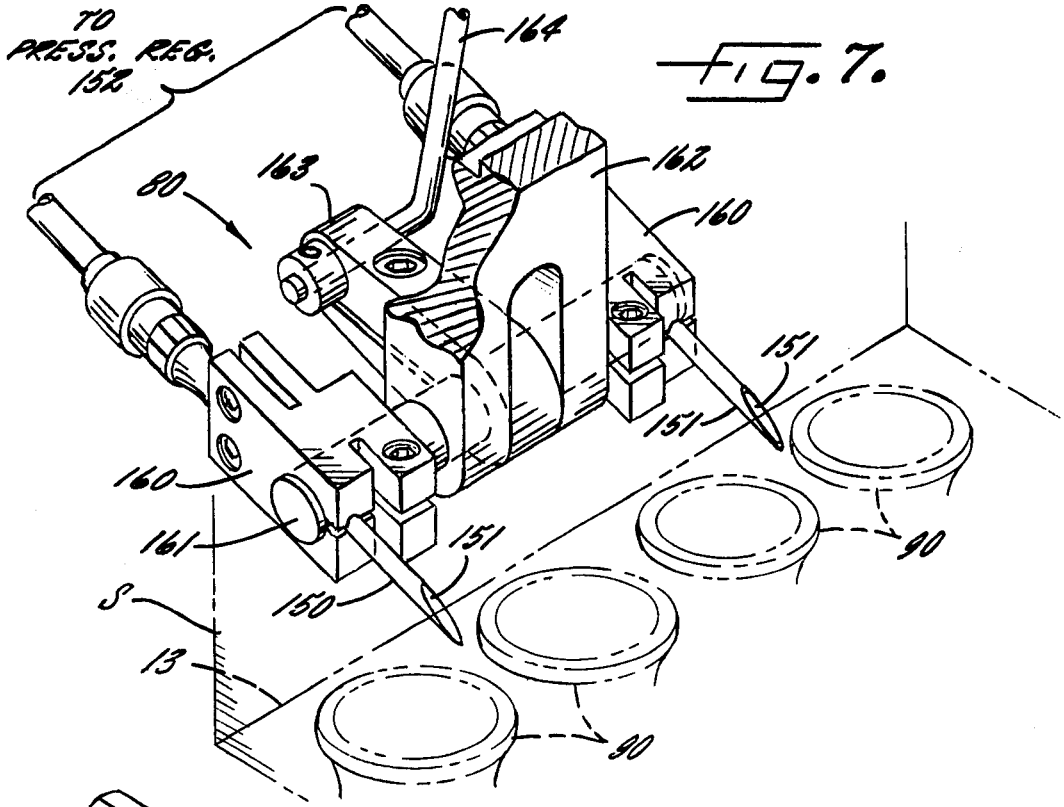

FIG. 7 is a fragmentary perspective showing the hollow needle supporting and angling structure.

Figure 8:
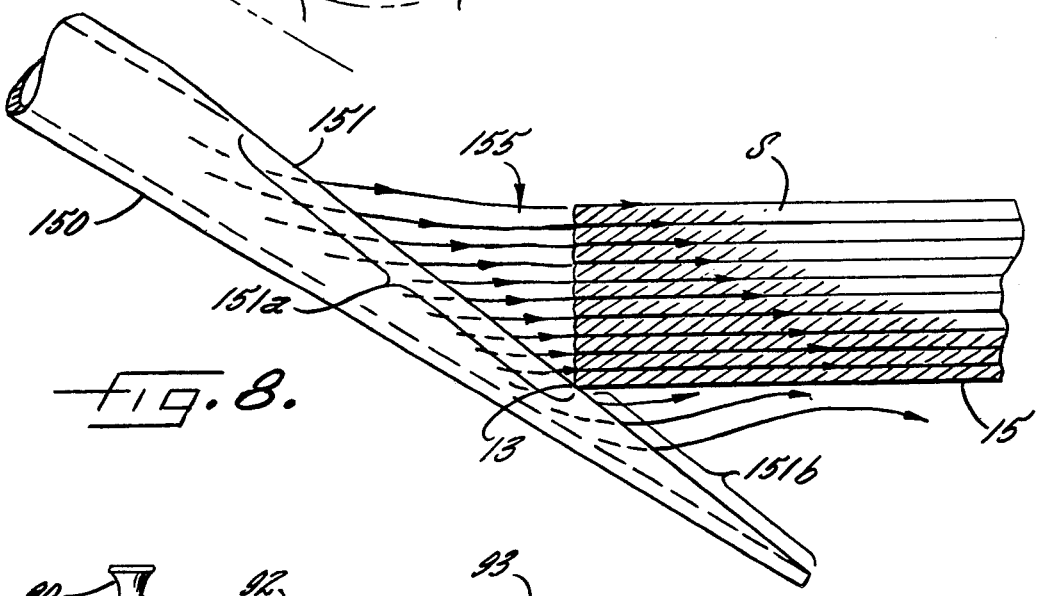

FIG. 8 is an enlarged fragment, in elevation, showing the tip of a needle in engagement with the front corner of the stack.

Figure 9:
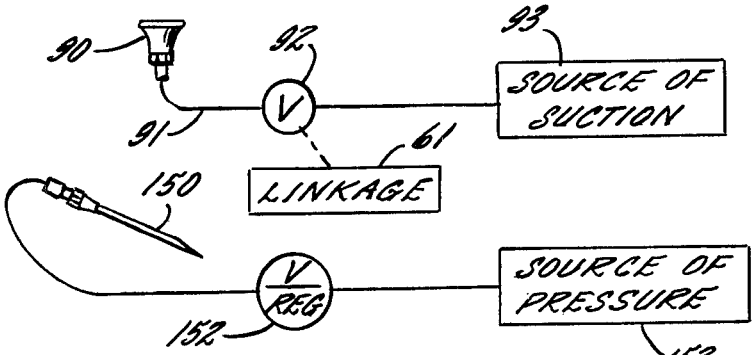

FIG. 9 is a schematic diagram of the vacuum and compressed air system.

While the invention has been described in connection with a preferred embodiment, it will be understood that there is no intention to limit the invention to the particular embodiment shown but it is intended, on the contrary, to cover the various alternative and equivalent constructions included within the spirit and scope of the appended claims.

Turning now to the drawings there is disclosed a machine for feeding cards one by one from the bottom of a vertical stack. Such machine has a frame 10 supporting a stack of cards S having leading edges 11 and trailing edges 12, the leading edges being in alignment with one another to form a lower corner 13 on the stack, with the bottom card of the stack being indicated at 15.

Figure 2:
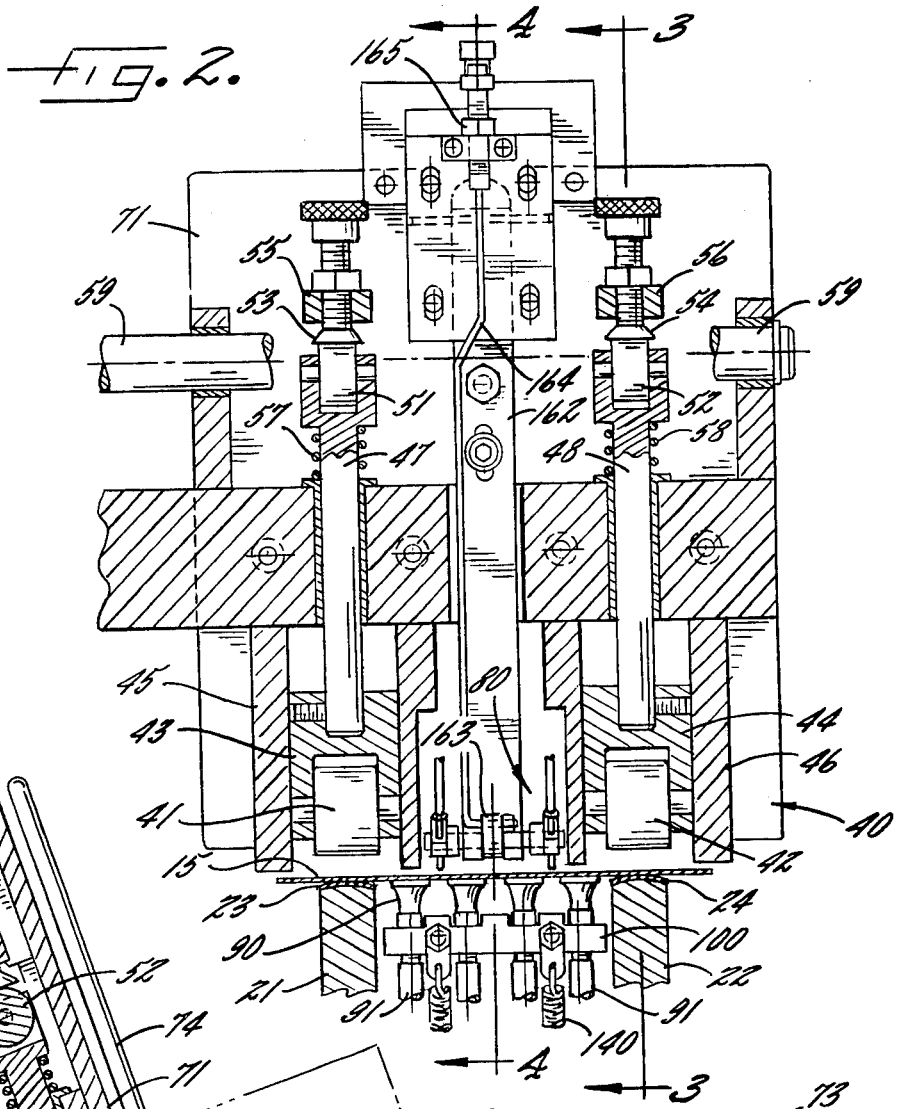
FIG. 2 is a vertical section looking along line 2—2 in FIG. 1.

Arranged in front of the stack is a transport system 20 having its inlet at a level slightly below the corner of the stack and including a pair of axially spaced narrow transport rollers 21, 22 encircled by belts 23, 24 (see also FIG. 2), respectively. The belts are trained about idler rollers 26, two of which are shown. In contact with the belts 23, 24 is a loop of belt 27, supported on idler rollers 28. The belts 23, 24 subsequently engage a mating transport belt 30 trained about rollers 31, 32. The belts are all formed as endless loops, with belts 27, 30 being of a width sufficient to span the pair of narrow belts 23, 24. The belts are driven in unison by any suitable means as, for example, a drive connection 34 from a drive motor 35.

Figures 1, 1A:
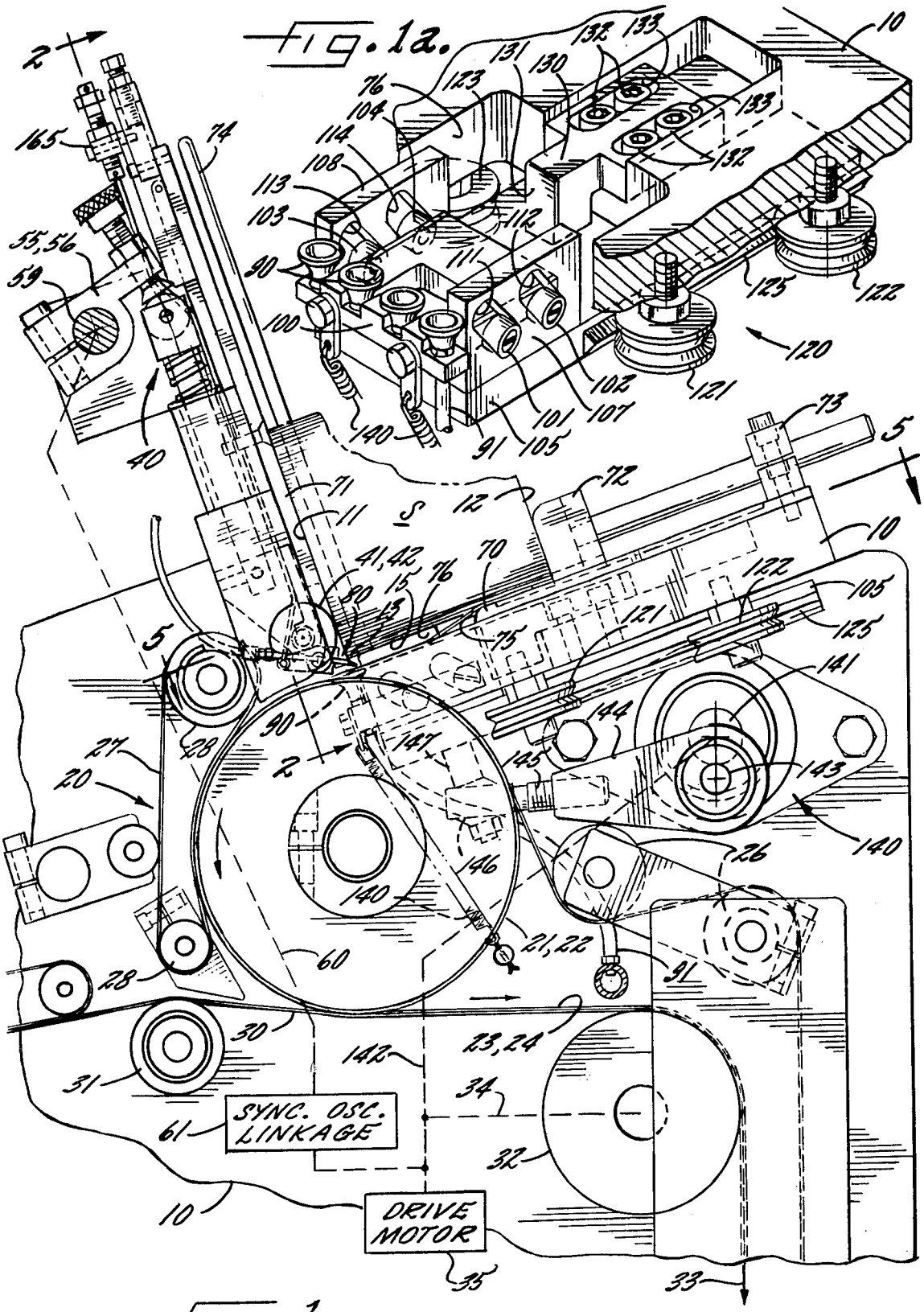

For engaging the leading edge of a card drawn from the stack S, a nip assembly 40 is provided which includes narrow nip rollers 41, 42 (see especially FIG. 2) which are respectively aligned with transport rollers 21, 22 having carriers 43, 44 mounted in vertical guideways 45, 46. The brackets are secured to plungers 47, 48 having cam followers 51, 52 at their upper ends respectively engaged by cams 53, 54. The cams are mounted upon arms 55, 56 which work against return springs 57, 58, the arms being mounted upon a rockable shaft 59 oscillated by a drive connection 60 (FIG. 1). The drive connection 60 includes a synchronized oscillating linkage 61 so that the nip rollers 41, 42 are thrust downwardly against the force of return springs 57, 58 into engagement with the belts on the transport rollers 21, 22 to form nips for receiving the presented edge of the bottom card, as will be further described in connection with the stop motion views in FIGS. *6a–6d*.

Figure 3:
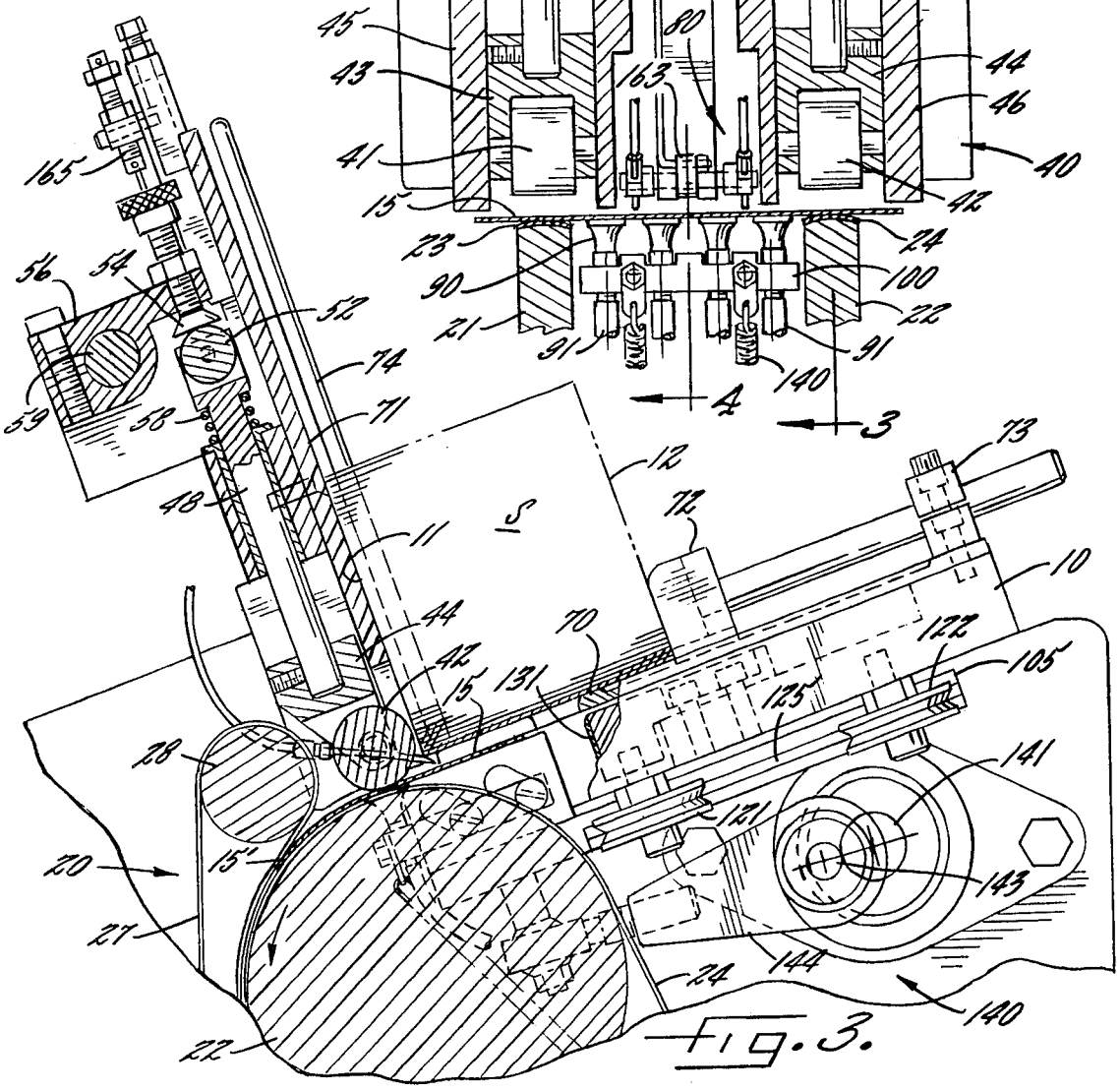
FIG. 3 is a vertical section taken along line 3—3 in FIG. 2.

Attention will next be given to the means for supporting the stack S. The main weight of the stack is borne by a platform 70 (FIGS. 1 and 3) which is under the trailing edge portion of the stack and thus in contact with the bottom card in the stack. At the front of the stack a vertical guide 71 is arranged at right angles to the platform for engaging the aligned leading edges 11. Opposite the vertical guide 71 is a rear guide 72 which is adjustably held in position by a clamp 73. The sides of the stack are engaged by vertical guide rods 74. The supporting platform 70 is foreshortened so that its front edge 75 defines an access window 76 at the leading edge portion of the stack. The lower, leading edge corner 13 of the stack is supported by a stripper type supporting assembly generally indicated at 80 which will subsequently be covered in detail. It will suffice at this point to say that the stripper type support is in the form of a pair of downwardly angled needles, the tips of which project a short distance under the leading edge portion of the stack so that when the bottom card is drawn downwardly, by sucker means to be described, the leading edge portion of the bottom card flicks past the needle projections thus stripping it from the stack.

In accordance with the present invention a set of suction cups face upwardly into the window 76 defined by the front edge 75 of the platform 70. The suction cups are supported on a sucker block which is supported by a sucker block carrier. Means are provided, in turn, for supporting the sucker block carrier on the frame of the machine for horizontal reciprocating movement in the forward and retract directions. A cam surface and cam follower are interposed between the sucker block and its carrier and a striker is provided on the frame fixedly arranged in the path of movement of the sucker block, the cam surface being so angled that when the carrier is retracted the sucker block engages the striker, blocking further movement of the sucker block in the retract direction but causing relative motion between the cam surface and cam follower in a direction to cam the sucker block upwardly for engagement of the suction cup with the underside of the bottom card, thereby completing an L-shaped path of movement for the suction cup. A biasing spring biases the sucker block downwardly with respect to the carrier so that in the subsequent forward stroke of the carrier the suction cups retrace their path moving downwardly until separation occurs at the striker and then forwardly. Suction is applied to the suction cups during their downward and forward movement so that the suckingly engaged bottom card flicks downwardly past the stripper type support at the front of the window, followed by outward feeding of the leading edge of the card into the receiving nip.

Thus, referring primarily to FIGS. 1 and 1*a*, a set of four suction cups 90 are provided facing upwardly into the window 76 and having respective suction lines 91 which are connected, via a valve 92 (FIG. 9) to a source of suction 93. The suction cups are supported upon a sucker block 100 having a pair of cam follower projections 101, 102 along one lateral edge and a similar pair of cam followers 103, 104 along the other. Arranged below the sucker block is a sucker block carrier 105 in the form of a plate having upstanding opposed walls 107, 108. The sucker block 100 is dimensioned to fit between the walls for free sliding movement. The walls have symmetrically angled slots 111, 112 and 113, 114, respectively, which define cam surfaces which receive the cam followers 101, 102 and 103, 104. The cam surfaces and cam followers provide freedom of vertical movement of the sucker block, and arranging such cams and cam followers in symmetrical pairs ensures that the sucker block, during the course of such vertical movement, will remain parallel to the carrier.

For the purpose of supporting the sucker block carrier on the frame for horizontal reciprocating movement in forward and retract directions, a mount 120 is provided made up of four grooved rollers 121, 122 on one side and 123, 124 on the other side, journalled on the frame 10 and lying in a common plane. The sucker block carrier is sharpened along its lateral edges 125, 126 for engagement of the roller grooves for substantially frictionless reciprocating movement with respect to the frame.

In accordance with one of the important features of the present invention, a striker is arranged on the frame fixed in the path of horizontal movement of the sucker block as the sucker block is moved by the carrier in the retract direction. The cam surfaces 111–114 are so angled that when the carrier 105 is retracted, the sucker block 100, during the course of such retracting movement, engaged the striker thereby blocking further movement of the sucker block in the retract direction but causing relative motion between the cam surfaces and cam followers in a direction to cam the sucker block upwardly via the access window 76 for engagement of the suction cups with the underside of the bottom card, thereby completing an L-shaped path of movement for the suction cups. The striker, indicated at 130, has a striking, or blocking, surface 131 and is secured to the frame 10 of the machine by a set of bolts 132 which penetrate longitudinal clearance slots 133 formed therein. A set of biasing springs 140 are provided for biasing a sucker block 100 downwardly with respect to the carrier so that in the subsequent forward stroke of the carrier the suction cups retrace their path of movement, moving downwardly until separation occurs at the striker and then forwardly so that the suckingly engaged bottom card, indicated at 15, flicks downwardly past the projection 80, thereby stripping the card from the stack followed by outward feeding of the leading edge of the card into the receiving nip.

Further in accordance with the invention, means including a crank and pitman are provided for reciprocating the sucker block carrier in the forward and retract directions. The crank and pitman assembly indicated generally at 140 (FIG. 1) includes a crankshaft 141 having a connection 142 to the drive motor 35. Eccentrically positioned on the shaft is a crank 143 which engages a pitman 144 having an adjustable leg 145 which is connected via a ball and socket connection 146 to a post 147 extending downwardly from the carrier.

The operation of the mechanism thus far described will be apparent upon considering the stop motion views *6a–6d* inclusive. In FIG. *6a* the carrier 105 is shown fully retracted with the sucker block 100 in engagement with the striking surface 131 on the striker 130, which engagement has caused the sucker block to ride upwardly on the cam surfaces 113, 114 against the force of the biasing springs 140. As a result the sucker 100 occupies its elevated position, with the suction cups 90 in contact with the leading edge portion of the bottom card 15. The valve 92 is coupled to the linkage 61 (FIG. 9) or, alternatively, to the shaft 141, so that the suction is turned on at least during the forward stroke of the pitman.

As the crankshaft 141 rotates in the counterclockwise direction the pitman 144 thrusts the carrier 105 forwardly, causing the cam surfaces 111–114 to move forwardly relative to the cam followers 101–104 on the sucker block. This permits the springs 140 to draw the sucker block 100 downwardly into the position illustrated in FIG. 6*b*. The resultant lowering of the suction cups 90, which suckingly engage the bottom card 15, cause the leading edge 15' of the bottom card to flick downwardly past the tips of the needle projections 80, thereby stripping the bottom card from the stack.

Continued forward movement of the pitman 144 results in separation of the sucker block 100 from the striking surface 131 of the striker, followed by forward movement of the sucker block in unison with the carrier until the carrier reaches the fully advanced position illustrated in FIG. 6*c*. Simultaneously, the nip rollers 41, 42, which initially occupy an upraised position as illustrated in FIGS. 6*a* and 6*b*, are lowered by the linkage 61, which is synchronously connected to the drive motor 35, so that the rollers 41, 42 engage the transport rollers 21, 22 to form a nip N which grippingly receives the leading edge portion of the card 15 as the card is advanced forwardly by the suction cups. As already indicated, the lowering of the nip rollers 41, 42 comes about by the rocking movement of the shaft 59 which rocks the arms 55, 56 down against the plungers 47, 48 against the restoring force of the coil springs 57, 58.

As soon as the leading edge of the card has been grasped in the nip, the suction is turned off by the valve 92 so that the card is pulled from under the stack and off of the supporting platform 70 into the path of transport. In the path of transport the card is first engaged between the pair of belts 23, 24 and the cooperating belt 27. When the card leaves the belt 27 it continues to be transported between the belts 23, 24 and the belt 30, being discharged along the path 33.

With the suction cups now free, the carrier 105, and with it the sucker block 100, move in the retract direction as indicated by the arrow in FIG. 6*d* until the sucker block engages the striking surface 131. This prevents the sucker block 100 from being retracted any further by the carrier; in other words, the sucker block is blocked in its horizontal movement. Thus, as the pitman 144 continues to retract the carrier, relative motion between the cam surfaces 111–114 and the cam followers 101–104 causes the sucker block 100 to be cammed upwardly against the force of the springs 140 until the suction cups 90 again occupy the starting position illustrated in FIG. 6*a*. The nip rollers 41, 42 are, during the retracting movement of the pitman 144, permitted by the oscillating linkage 61 to be moved by the coil springs 57, 58 back to the upraised position illustrated in FIG. 6*a*.

The cycle is endlessly repeated at a high repetitive rate which may, in a practical case, approach 300 cards per minute. Notwithstanding the impact with the striker 130 which occurs during each feeding cycle, experience has shown that the operation occurs smoothly with a minimum of noise and vibration. Preferably, the striking surface 131 is padded with a layer of cushioning material having a low coefficient of friction as, for example, Teflon. To bring about a still further reduction in the energy of impact, the sucker block 100 may be formed of a lightweight plastic material and, if desired, the striker 130 itself may be formed of a material having sound and vibration deadening characteristics.

In accordance with one of the features of the present invention, means are provided for adjusting the point in the path of retracting movement of the sucker block in which the sucker block engages the striker. More specifically, the striker 130 is relatively adjustable in horizontal position with respect to the frame to vary the point in the path of retracting movement of the sucker block at which striking occurs thereby to adjust the upper limit position reached by the suction cups 90. In short, the earlier in the path of retracting movement that striking occurs, the higher will be the maximum elevation of the suction cups. Adjustment of the striker 130 thereby serves as a convenient way of optimizing contact between the suction cups 90 in the lowermost card. The adjustment is not, however, critical provided that the suction cups are made of rubber or similar yieldable material.

Moreover, screwing in or out of the adjustable leg 145 of the pitman determines the forward limit position of the card and, consequently, the degree to which the leading edge of the card is inserted into the nip N at the end of the forward stroke.

In accordance with one of the important aspects of the present invention the stripper type support at the front corner of the stack is in the form of one or more needles having a downwardly angled tip portion extending inwardly and downwardly with respect to the window by a shallow amount so that the leading edge of the bottom card rests against the tip portion of the needle, the needle being of hollow construction and fed a source of pressurized air. The tip portion of each needle has a longitudinally extending discharge orifice which faces upwardly and which extends both above and below the corner of the stack, dividing the orifice into an upper portion and a lower portion. The air which is fed to the needle is at a sufficiently high pressure so that air from the upper portion of the orifice is forced between the lowermost cards in the region above the suctions cups thereby breaking any suction which may exist between the cards and serving as a lubricant for the bottom card facilitating its prompt release from the stack upon downward movement of the suction cups.

Thus, referring to FIGS. 7 and 8 the stripper type supporting assembly 80 includes a pair of hollow needles 150. The tips of the needles have longitudinally extending discharge orifices 151. The orifices are preferably formed by beveling the needles at a shallow angle. The needles are so positioned with respect to the stack that the corner 13 of the stack is engaged approximately midway along the orifices 151, dividing each orifice into an upper portion 151*a* and a lower portion 151*b* (see FIG. 8). Compressed air is fed to the needles 150 through a pressure regulator 152 (FIG. 9) which is connected to a source of pressure 153. In practice, the needles 150 may be approximatley 1/16th inch in inner diameter cut on an angle of about 5° to about 15°, preferably 7°, and producing an orifice which has a slant length on the order of ⅜". The pressure furnished to the needles may be within the range of 3 lbs. per square inch to 50 lbs. per square inch, as set by the pressure regulator.

As illustrated in FIG. 8, the compressed air, indicated at 155 and which exits at the upper portion 151*a* of the orifice, is travelling at a sufficient velocity as to force its way between the adjacent cards, paritcularly the bottom card and the one above it.

As is well known, the cards normally included with a periodical are often made of porous relatively inexpensive stock. Because of the porosity, the application of suction by the cups 90 to the bottom card results in suction being created between the bottom card and the second, and sometimes even third and fourth cards in the stack. Thus, when the suction cups are drawn downwardly, they tend to take along not only the bottom card but the second card as well, by reason of the suction between the cards. This problem, referred to as "double document " feeding, is accentuated by the fact that, where the cards are in a stack of substantial height, the weight of the stack on the tip portion of the needle results in high concentration of force at the point of support, so that the bottom card of the stack tends to be "pinched" between the stack and the needle, wedging the bottom card so tightly in place that it resists dislodgement. This requires that relatively high levels of vacuum must be used for reliable draw-down of the bottom card, increasing the likelihood that suction will exist between the bottom card and the one next to it, particularly where the cards are of thin porous stock and free of any surface coating.

By the use of hollow pressurized needles as a stripper type support for the leading edge corner of the stack reliable "single document" feeding is assured regardless of the porosity or other characteristics of the card stock. Moreover, the compressed air which is forced between the adjacent cards serves as an effective lubricant so that the bottom card is more easily removed regardless of its "pinched" condition.

Figure 4:
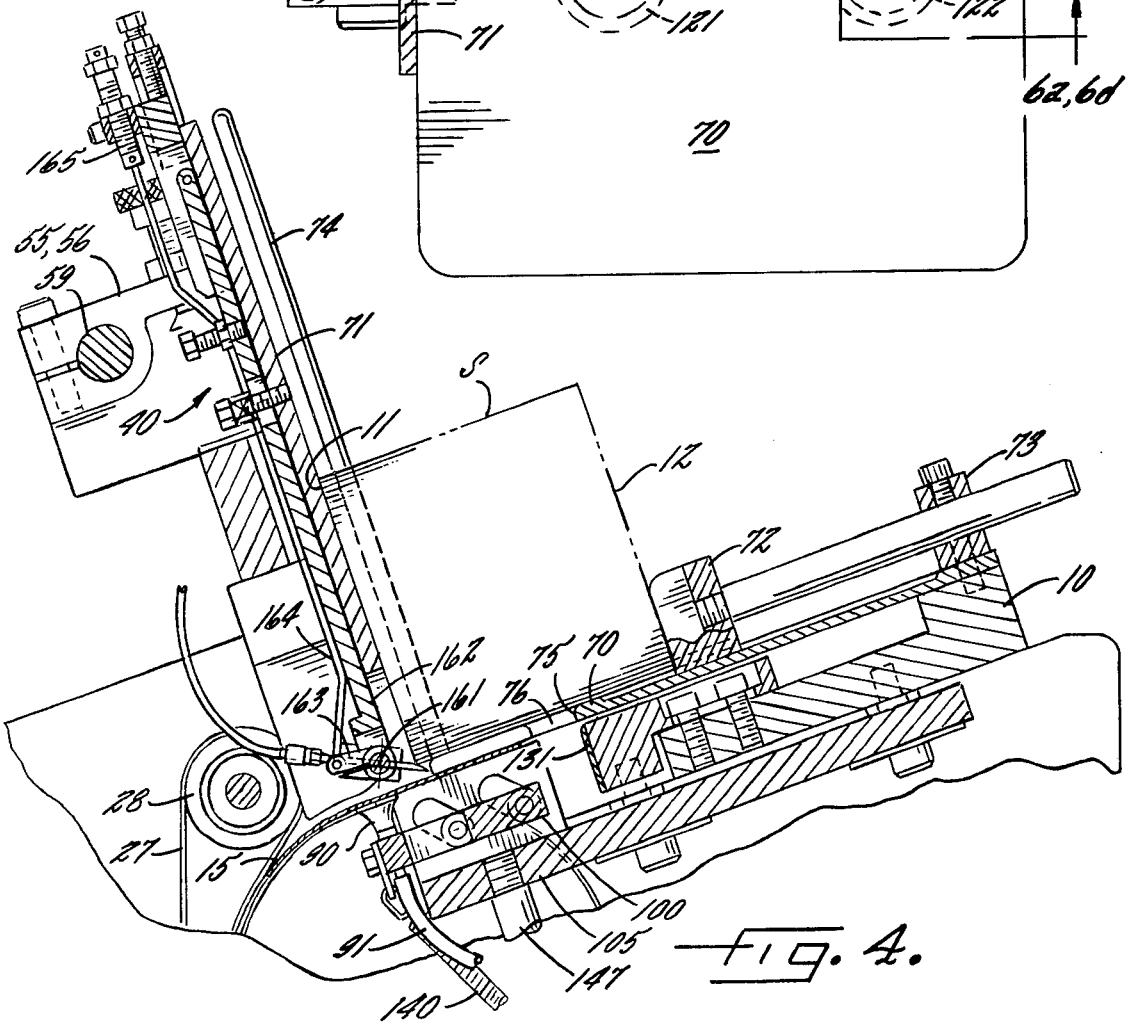
FIG. 4 is a displaced vertical section taken along line 4—4 in FIG. 2.

In accordance with one of the aspects of the present invention, means are provided for varying the downward angling of the needle with respect to the plane of the bottom card. This is accomplished, as shown in FIGS. 4 and 7, by mounting each needle in a rockable support, or chuck, 160 which is mounted upon a shaft 161 journalled in a bracket 62. Rigidly clamped to the center of the shaft is an actuating arm 163 to which is coupled a vertical pushrod 164, at the upper end of which is an adjuster 165. The optimum angle between the needle axis and the plane of the bottom card is preferably on the order of 28°. By use of the above described adjusting mechanism such angle may be varied between about 10° and about 45°. The needles 150 are preferably spaced from one another at such a distance as to be interspersed between the suction cups 90, as illustrated in FIG. 7. By interspersing the needles between the suction cups a minimum of downward movement of the cups is required to flick the leading edge of the card into its free, stripped condition.

While the invention has been described in connection with a pair of needles supporting the leading edge portion of the stack, it will be apparent to one skilled in the art that, if desired, a single needle might be relied upon or, alternatively, three or even four needles, operating in parallel, might be used.

By using movable nipping rollers the amount of movement into the nip brought about, as stated, by adjustment of the length of the pitman, is noncritical and may even be excessive, with overtravel of the card in the forward direction, without any obstruction or tendency toward buckling.

Generally stated, single card feeding and transport at high speed achieved by the mechanism described above is highly reliable and adjustments are simple and noncritical and, once made, are preserved for long periods of time regardless of the characteristics of the paper stock being employed and regardless in variations in the dimension of the card.

To keep the stack of cards in accurate and constant alignment with the front guide 71, thereby to keep the lower, leading corner 13 of the stack at a reference position with respect to the orifices in the hollow needles, the entire machine is "rocked" forwardly through a small angle with respect to the vertical, as set forth, for example, in FIG. 1. Accordingly, the terms "vertical" and "horizontal" will be understood to be relative terms related to the height dimension of the stack.

I claim:

1. A machine for feeding cards one by one from a vertical stack having a leading edge portion and a trailing edge portion, the cards in the stack having their leading edges in alignment with one another to form a lower corner on the stack, comprising, in combination, a frame, means defining a receiving nip arranged downwardly and outwardly from the lower corner of the stack, a platform on the frame positioned to support the trailing edge portion of the stack and in contact with the bottom card in the stack, a vertical guide arranged at right angles to the platform for engaging the aligned leading edges of the cards in the stack, the edge of the platform being horizontally spaced from the vertical guide to define a downwardly facing access window at the leading edge portion of the stack, a stripper type support for the lower corner of the stack in the form of a projection extending under the corner of the stack a short distance inwardly of the vertical guide, a suction cup facing upwardly into the window, a source of suction coupled to the suction cup, a sucker block for supporting the suction cup, a sucker block carrier, means for supporting the sucker block carrier on the frame for horizontal reciprocating movement in forward and retract directions, a drive for reciprocating the carrier, the sucker block being mounted for horizontal and vertical movement with respect to the carrier between an upraised position in which the suction cup engages the bottom card and a relatively lowered position, a cam surface and cam follower interposed between the sucker block and carrier for imparting vertical movement to the sucker block, a striker on the frame fixedly arranged in the path of horizontal movement of the sucker block as the sucker block is moved by the carrier in the retract direction, the cam surface being so angled that, when the carrier is retracted, the sucker block, during the course of such retracting movement, engages the striker blocking further movement of the sucker block in the retract direction but causing relative motion between the cam surface and cam follower in a direction to cam the sucker block upwardly for engagement of the suction cup with the underside of the bottom card thereby completing an L-shaped path of movement for the suction cup, a biasing spring for biasing the sucker block downwardly with respect to the carrier so that in the subsequent forward stroke of the carrier the suction cup retraces its path moving downwardly until separation occurs at the striker and then forwardly, and means timingly coupled to the drive for applying suction to the suction cup during its downward and forward movement so that the suckingly engaged bottom card flicks downwardly past the projection for stripping from the stack followed by outward feeding of the leading edge of the card into the receiving nip.

2. A machine for feeding cards one by one from a vertical stack having a leading edge portion and a trailing edge portion, the cards in the stack having their leading edges in alignment with one another to form a lower corner on the stack, comprising, in combination, a frame, means defining a receiving nip arranged downwardly and outwardly from the lower corner of the stack, a platform on the frame positioned to support the trailing edge portion of the stack and in contact with the bottom card in the stack, the edge of the platform being horizonally spaced from the corner of the stack to define a downwardly facing access window at the leading edge portion of the stack, a stripper type support for the leading edge portion of the stack in the form of a projection extending a short distance under the stack, a suction cup facing upwardly into the window, a source of suction coupled to the suction cup, a sucker block for supporting the suction cup, a sucker block carrier, means for supporting the sucker block carrier on the frame for horizontal reciprocating movement in forward and retract directions, a drive for reciprocating the carrier, the sucker block being mounted for horizontal and vertical movement with respect to the carrier between an upraised position in which the suction cup engages the bottom card and a relatively lowered position, a cam surface and cam follower interposed between the sucker block and carrier for imparting vertical movement to the sucker block, a striker on the frame fixedly arranged in the path of horizontal movement of the sucker block as the sucker block is moved by the carrier in the retract direction, the cam surface being so angled that, when the carrier is retracted, the sucker block, during the course of such retracting movement, engages the striker blocking further movement of the sucker block in the retract direction but causing relative motion between the cam surface and cam follower in a direction to cam the sucker block upwardly for engagement of the suction cup with the underside of the bottom card thereby completing an L-shaped path of movement for the suction cup, means for biasing the sucker block downwardly with respect to the carrier so that in the subsequent forward stroke of the carrier the suction cup retraces its path moving downwardly until separation occurs at the striker and then forwardly, and means coupled to the source of suction for applying suction to the suction cup during its downward and forward movement so that the suckingly engaged bottom card flicks downwardly past the projection for stripping from the stack followed by outward feeding of the leading edge of the card into the receiving nip.

3. The combination as claimed in claim 1 or in claim 2 in which means are provided for adjusting the point in the path of retracting movement of the sucker block in which the sucker block engages the striker thereby to adjust the upper limit position reached by the suction cup.

4. The combination as claimed in claim 1 or claim 2 in which the striker is relatively adjustable in horizontal position with respect to the frame to vary the point in the path of retracing movement of the sucker block at which striking occurs thereby to adjust the upper limit position reached by the suction cup.

5. The combination as claimed in claim 1 or in claim 2 in which the carrier is formed of a flate plate having a pair of longitudinally extending vertical walls spaced in opposed relation having symmetrically angled slots formed therein defining cam surfaces, the sucker block being dimensioned to fit between the walls for free sliding movement, the sucker block having lateral projections extending into the respective slots to form cam followers imparting vertical movement to the sucker block.

6. The combination as claimed in claim 1 or in claim 2 in which the carrier includes a flat plate having sharpened lateral edges, grooved rollers mounted on the frame for engaging the lateral edges to permit reciprocation of the carrier, the flat plate having a pair of longitudinally extending vertical walls spaced in opposed relation, each wall having a pair of symmetrically angled slots formed therein defining cam surfaces, the sucker block being dimensioned to fit between the walls for free sliding movement, the sucker block having a pair of lateral roller projections on each of its lateral edges extending into the respective slots to form cam followers for imparting vertical movement to the sucker block while maintaining the sucker block parallel to the carrier.

7. The combination as claimed in claim 1 or in claim 2 in which the drive for reciprocating the sucker block carrier includes a crank and pitman, the pitman having means for adjusting its effective length thereby to adjust the limit position of the card with respect to the receiving nip in its forward feeding movement.

8. The combination as claimed in claim 1 or in claim 2 in which the means defining a receiving nip includes a transport roller and a narrow nip roller, a movable supporting bracket for the narrow nip roller, and means coupled to the drive for reciprocating the bracket between a retracted position and a working position in which the narrow nip roller engages the transport roller to create the nip, the movement into working position being synchronized with the outward feeding movement of the card, and means for conveying the card from the transport roller.

9. The combination as claimed in claim 1 or in claim 2 in which the means defining a receiving nip includes a pair of narrow transport rollers axially spaced from one another in straddling relation to the sucker block, a pair of narrow nip rollers respective aligned with the transport rollers, each of the narrow nip rollers having a vertically movable carrier, and means coupled to the drive for reciprocating the brackets between a retracted position and a working position in which the nip rollers engage the transport rollers to create the nip, the movement of the nip rollers into working position being synchronized with the outward feeding movement of the card, and means for conveying the card from the transport rollers.

* * * * *